United States Patent [19]

Kimura

[11] Patent Number: 4,549,392

[45] Date of Patent: Oct. 29, 1985

[54] YARN SPLICING DEVICE FOR SPUN YARNS

[75] Inventor: Hidetoshi Kimura, Kyoto, Japan

[73] Assignee: Murata Kikai Kabushiki Kaisha, Japan

[21] Appl. No.: 607,615

[22] Filed: May 7, 1984

[30] Foreign Application Priority Data

May 10, 1983 [JP] Japan ..... 58-82058

[51] Int. Cl.[4] ..... D01H 15/00

[52] U.S. Cl. ..... 57/22

[58] Field of Search ..... 57/22, 261, 263

[56] References Cited

U.S. PATENT DOCUMENTS 4,411,128 10/1983 Mima ..... 57/22

4,433,534 2/1984 Mima ..... 57/22

4,481,761 11/1984 Kimura ..... 57/261 X 4,494,366 1/1985 Deno ..... 57/22

*Primary Examiner*—Donald Watkins

*Attorney, Agent, or Firm*—Spensley, Horn, Jubas & Lubitz

[57] ABSTRACT

A yarn splicing device for spun yarns to each other wherein end sections of two yarns are untwisted and placed in overlapping relationship one on the other and thus overlapping portions of the yarns are acted by fluid to intended splicing of the yarns. An untwisting nozzle of the yarn splicing device comprises a fluid injecting hole formed to open to an inner circumferential face of a nozzle pipe and an intercepting plate disposed on a portion of the inner circumferential face of the nozzle.

11 Claims, 33 Drawing Figures

YARN SPLICING DEVICE FOR SPUN YARNS

BACKGROUND OF THE INVENTION

1. Field of the Invention

This invention relates to a yarn splicing device for spun yarns.

2. Prior Art

Among various methods of splicing spun yarns, there is a yarn splicing method which utilizes fluid and is advantageous in reduction of occurrence of troubles such as breaks or catches of yarns and so on in succeeding production steps such as knitting, weaving or the like since a joint of yarns obtained by the method do not present a knot compared with a conventional knot such as a fisherman knot or a weaver's knot. In particular, in a pneumatic yarn splicing device which employs air as a fluid, end sections of both yarns to be spliced are put in order in a yarn splicing hole, and overlapping portions of the yarn end sections are acted upon by an air flow to obtain a joint. In this method, however, it is a very effective means for obtaining a good joint to untwist the twist of the yarn end sections in prior to a yarn splicing operation and/or to separate and partially remove fibers adjacent extremities of the yarn end sections to shape each of the extremity portions of the yarn end sections into a tapered configuration.

The present applicant already filed patent applications such as, for example, a Japanese laid-open patent No. 54-7350 (Japanese publication patent No. 56-47108), for a device wherein end sections of yarns are sucked into a yarn end controlling nozzle in which fibers at extremity portions of the yarn end sections are separated from one another whereafter the yarn end sections are placed in order into a yarn splicing nozzle and are acted upon by an injecting air flow to effect intended splicing of the yarns. In this device, the nozzle for untwisting yarn end sections which is called a yarn end controlling nozzle is for use with single yarns and is thus suitable and convenient for untwisting single yarns wherein the peculiar twist provided to the yarns is only one of the Z and S twists. However, there yarns to be spliced are each a ply yarn, they cannot at all be untwisted by the untwisting nozzle of the device.

In particular, in what is called a ply yarn consisting of two or more mutually twisted single yarns, the twist peculiar to the single yarns (hereinafter referred to as "first" twist) and the twist peculiar to the ply yarn (hereinafter referred to as "second twist) consisting of the mutually twisted single yarns are opposite in directions relative to each other, and by this reason, such ply yarns cannot be untwisted by the untwisting nozzle as described above. For example, in case of a ply yarn wherein the first twist is the S twist and the second twist is the Z twist, if an end section of the ply yarn is whirled in one direction, for example, in a direction to untwist the Z twist, the second twist which is the Z twist can be untwisted and hence two single yarns of the ply yarn can be separated from each other, but the S twist provided to the individual single yarns cannot be untwisted successfully. In order to untwist the twist of the single yarns, a whirling flow must be additionally produced in a direction to untwist the S twist. But it is difficult to produce air flows in opposite directions within an untwisting nozzle with an instantaneous time lag one after the other, and even if this should be possible, the arrangement should have to become complicated.

SUMMARY OF THE INVENTION

An object of the present invention is to provide a yarn slicing device which can untwist a ply yarn only by providing a single untwisting nozzle which has a single fluid injecting hole formed therein.

According to the present invention, each of untwisting nozzles provided adjacent opposite sides of a yarn splicing member of the yarn splicing device comprises a fluid injecting hole formed to open to an inner circumferential face of a cylindrical nozzle pipe, and an intercepting plate disposed on a portion of the inner circumferential face of the nozzle opposing to the fluid injecting hole and having a face different from the inner circumferential face of the pipe such that the intercepting plate may positively promote a tendency to convert, when an air flow injected from the fluid injecting hole collides with the intercepting plate, a whirling flow, whereby the first twist and the second twist of a ply yarn which are different in twisting directions from each other can be untwisted by the whirling flow directly after injection thereof and the turbulent flow.

DETAILED DESCRIPTION OF THE INVENTION

Embodiment of the present invention will now be described in detail with reference to the accompanying drawings.

It is to be mentioned here that the term "yarn" used in the following description denotes a ply yarn and each of single yarns constituting such a ply yarn is a spun yarn constituted from a bundle of natural fibers such as cotton, wool, hemp and so on, or what are called staple fibers which are produced by cutting long chemical fibers short, and a mixture of such fibers, each single yarn having a peculiar number of twists indicated by the number of twists per unit length provided by a spinning step, the twist being distributed uniformly over the entire length of the single yarn, the ply yarn which is obtained by twisting a plurality of single yarns having a twist in a direction opposite to the direction of the twist peculiar to the individual single yarns, and the twist of the ply yarn being also distributed uniformly over the entire length of the double yarn.

Additionally, the term "untwisting" normally means cancelling the twist peculiar to a yarn, but here it denotes not only cancelling the twist of a yarn to such a degree that the yarn has no more twist but also cancelling part of the twist of a yarn.

Figure 1:
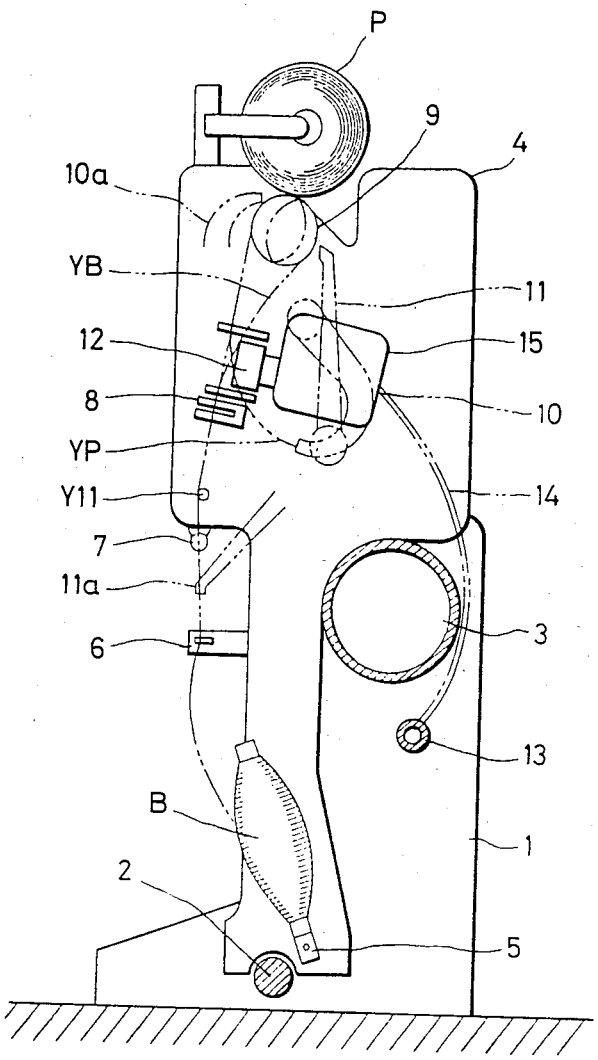
FIG. 1 is a side elevational view showing a general construction of a winding unit of an automatic winder having a yarn splicing device.

FIG. 1 shows a schematic representation of an automatic winder to which a yarn splicing device is applied. The automatic winder includes a shaft 2 and a suction pipe 3 which extend between opposite side frames 1. A winding unit 4 is mounted for pivotal motion on the shaft 2, and during operation of the automatic winder, it is received by and suitably secured also to the pipe 3. The pipe 3 is connected to a blower not shown and is always acted upon by suction air flows.

On the winding unit 4, a yarn is rewound from a bobbin 8 onto a package P, and during such a rewinding operation, the yarn Y11 is drawn out from the bobbin B on a peg 5, passing a guide 6, a tenser 7 and a slub catcher 8, and is taken up onto the package P which is rotated by a winding drum 9.

During the rewinding operation, if an irregularity of the yarn is detected by the slub catcher 8, a cutter which is disposed either within or in the neighborhood of the slub catcher is rendered operative and cuts the thus running yarn Y11 to stop the rewinding operation in order to thereafter effect a yarn splicing operation. In particular, a suction mouth 10 is rendered operative to introduce a yarn YP on the package to a yarn splicing device 12 which is disposed at a position spaced from a normal running path while a relay pipe 11 is rendered operative to introduce another yarn YB on the bobbin also to the yarn splicing device 12. At this yarn splicing device 12, both yarns YP and YB are spliced to each other and then a rewinding operation is resumed. The suction pipes 10 and the relay pipes 11 are both connected to the pipe 3 which is acted upon by suction air flows. A conduit 14 is connected between a compressed air supply pipe 13 of a different system and a yarn splicing unit 15 in order that fluid such as compressed air or the like may be used for the yarn splicing device 12.

Figure 2:
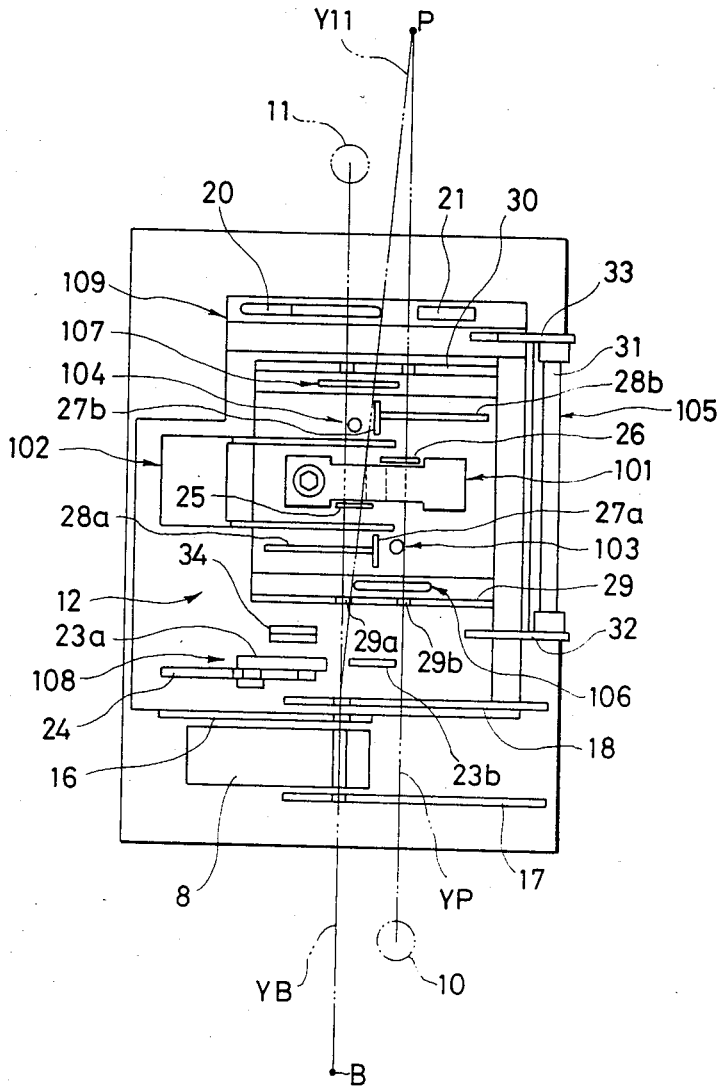
FIG. 2 is a front elevational view showing an example of a pneumatic yarn splicing device.
Figure 3:
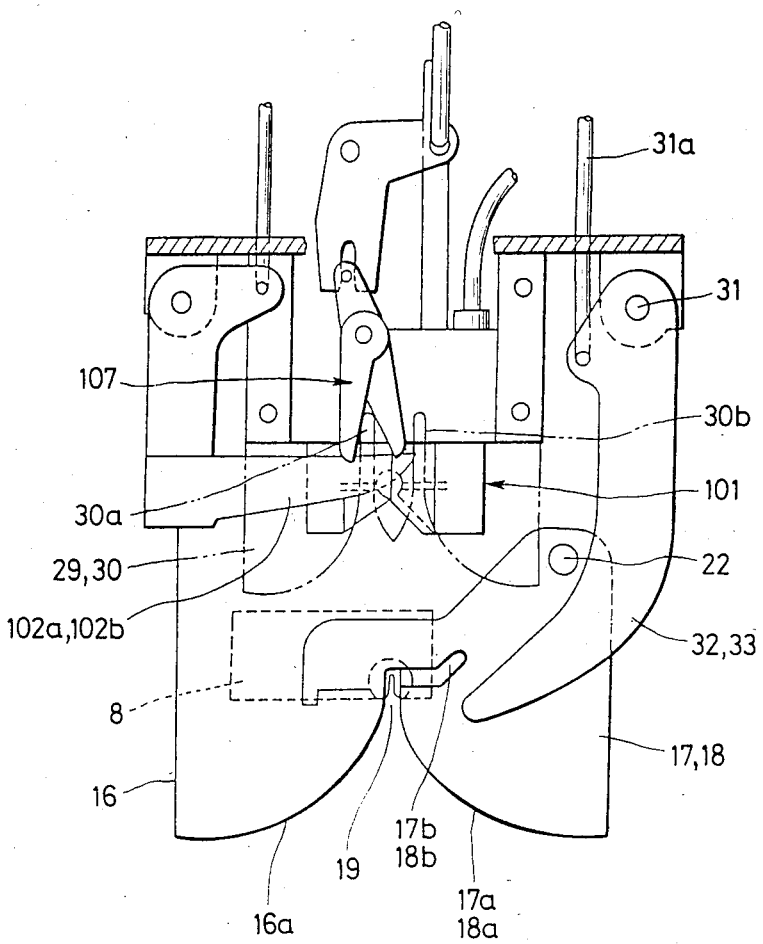
FIG. 3 is a plan view of the pneumatic yarn splicing device of FIG. 2.

General construction of the yarn splicing device 12 is illustrated in FIGS. 2 and 3. During a normal rewinding operation, a yarn Y11 takes a route extending from a bobbin B to a package P passing the slub catcher 8, a fixed guide 16 disposed adjacent one side of the slub catcher 8 and pivotal guides 17 and 18 disposed adjacent opposite sides of the slub catcher 8 and passing over the yarn splicing device 12.

The yarn splicing device 12 basically includes a yarn splicing member 101, a yarn holding device 102, untwisting nozzles 103 and 104, a yarn handling lever 105, yarn cutting devices 106 and 107 and yarn clamping devices 108 and 109. The suction arms 10 and the relay pipes 11 are pivotally moved such that suction openings provided at ends thereof intersect each other above the yarn splicing device 12, and after an end section YP of a yarn on the package and an end section YB of another yarn on the bobbin are sucked into the suction openings, they are moved to and stop at respective positions outside the yarn splicing device.

It is to be noted that operations of the suction arm 10 and the relay pipes 11 occur not at the same time but with some time lag one after the other. In particular, at first the yarn end section YP on the package is pivotally moved to and stops at a position outside the yarn splicing device by the suction mouth 10, and substantially at the same time, a pivotal lever 20 of the clamping device 109 on the package P side is pivoted by means of a control cam not shown until it is abutted against and stopped by a support block 21 secured to a fixed position. At this instant, the yarn YP is engaged and moved by the pivotal lever 20 until it is clamped between the support block 21 and the pivotal lever 20.

In the meantime, while the pivotal lever 20 is moving, portions of the yarn YP positioned on the fixed guide 16 and the pivotal guides 17 and 18 are guided along inclined faces 16*a*, 17*a* and 18*a* of the guides 16, 17 and 18 and enter a guide groove 19. Then, it is confirmed by the detecting device 8 disposed in the same station with the guide groove 19 if the yarn YP is present or not and if there are two yarns sucked by the suction mouth in error, and after the yarn YP is confirmed, the pivotal guides 17 and 18 are pivoted in a counterclockwise direction around a support shaft 22 by means of control cams not shown so that the yarn YP is removed from the slub catcher 8 and is then fitted into relief grooves 17*b* and 18*b* of the pivotal guides 17 and 18.

Then, substantially at the same time with the pivotal motions of the pivotal guides 17, 18, the yarn end section YB on the bobbin B side is sucked by the relay pipe 11 and is pivoted in a direction opposite to the pivoting direction of the suction mouth 10 until it is moved to and stopped at a position outside the yarn splicing device. Substantially at the same time with stopping of the pivotal motion of the relay pipe 11, a support plate 23*a* of the clamping device 108 is moved in the same direction with the pivotal lever 20 along a guide plate 24 by means of a control cam not shown, and during this movement, it is engaged with the yarn YB. This movement of the support plate 23*a* is stopped when it is abutted against a support block 23*b* secured at a fixed position and the yarn YB is thus clamped between the support plate 23*a* and the support block 23*b*.

Located substantially at the center of the yarn splicing device 12 is the yarn splicing member 101, and adjacent opposite sides of the yarn splicing member 101, yarn end controlling plates 25 and 26, the yarn pressing device 102, the untwisting nozzles 103 and 104, guide plates 27*a* and 27*b* and guide rods 28*a* and 28*b*, the yarn cutting devices 106 and 107, and fork guides 29 and 30 are disposed in order. Adjacent one side of the yarn splicing device 101, the yarn handling lever 105 is disposed which includes a support shaft 31 and a pair of levers 32 and 33 mounted for pivotal motion on the support shaft 31. The yarn handling lever 105 guides the yarn end sections YP and YB toward the yarn splicing device 12 after the yarn end sections YP and YB have been guided to respective positions outside the yarn splicing device 12 by the suction arm and the relay pipes, respectively. It is to be noted that the yarn handling lever 105 is pivoted within an extent which is defined by a stop 34 disposed for engagement therewith between the fork guide 29 and the yarn clamping device 108.

Figure 4:
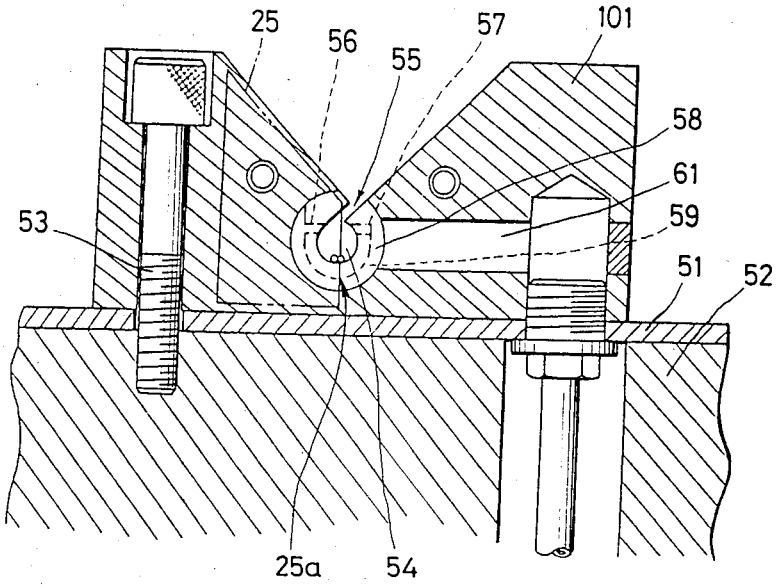
FIG. 4 is a sectional plan view showing an example of a yarn splicing member.

An example of the yarn splicing device 101 is illustrated in FIG. 4. The yarn splicing device 101 is secured to a bracket 52 by means of a screw 53 via a front plate 51 and has a cylindrical yarn splicing hole 54 formed substantially at the center thereof. A slit 55 sufficient to allow yarns YP, YB to be introduced into the same from the outside is formed to extend in a tangential direction from the yarn splicing hole 54 through the yarn splicing member 101. The yarn splicing member 101 further has fluid injecting nozzle holes 56 and 57 formed therein such that they are opened tangentially to the yarn splicing hole 54. The nozzle holes 56 and 57 are provided at different locations in a direction of the axis of the yarn splicing member 101, and flows of fluid injected from the openings of the nozzles thus have opposite whirling directions to each other.

It is to be mentioned that various arrangements of a fluid injecting nozzle or nozzles are possible such as, for example, a fluid injecting nozzle provided in a tangential relationship at a single location or fluid injecting nozzles provided at two or more locations.

Figure 5:
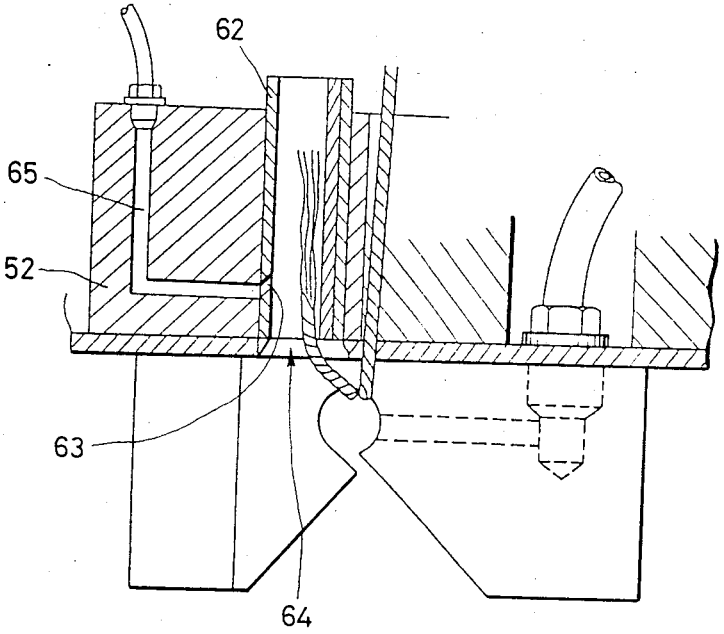
FIG. 5 is a plan view, partly in section, showing relations between the yarn splicing device and a yarn end untwisting nozzle.
Figure 6:
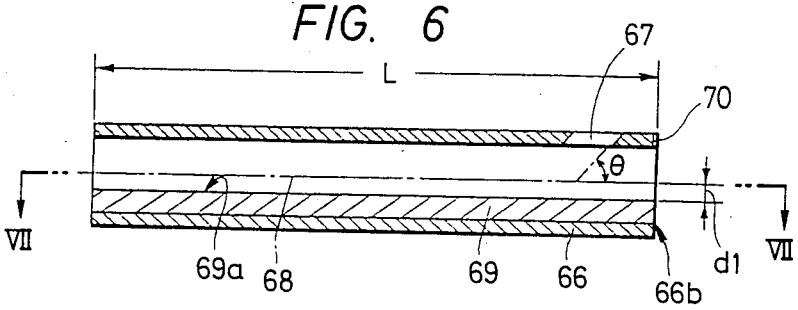
FIGS. 6 to 9 illustrate a first embodiment of the yarn end untwisting nozzle, and FIG. 6 being a vertical sectional view taken along a plane which passes an axis of a nozzle pipe and extends in parallel with the axis, FIG. 7 being a sectional view taken along line VII—VII of FIG. 6, FIG. 8 being an enlarged view of a right hand side face of the pipe of FIG. 6, and FIG. 9 being an enlarged view of a left hand side face of FIG. 6.
Figure 7:
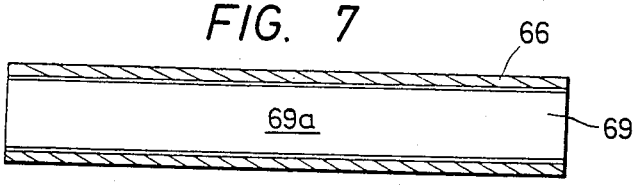
Figure 8:
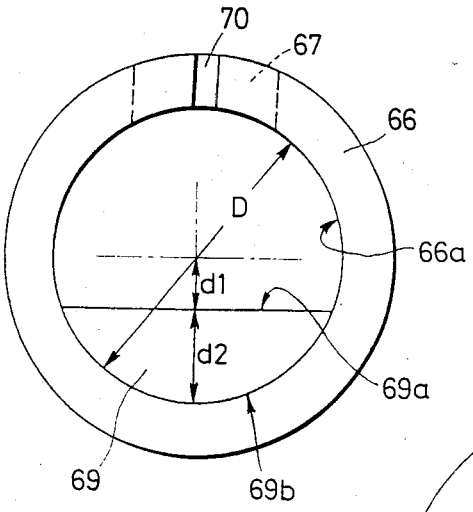
Figure 9:
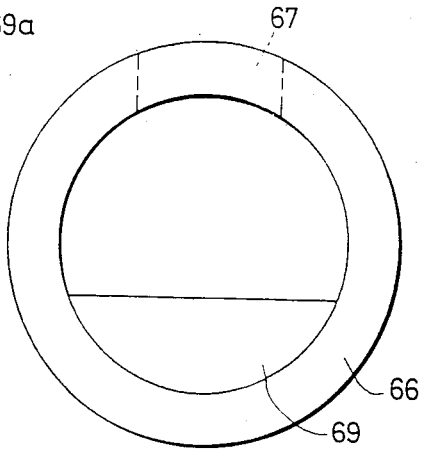
Figure 10:
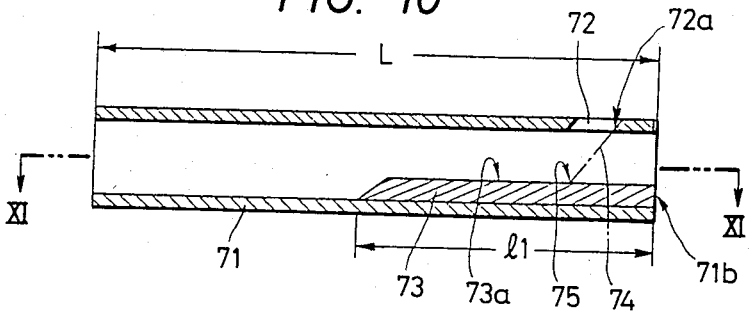
FIGS. 10 to 13 are views illustrating a second embodiment of the untwisting nozzle.
Figure 11:
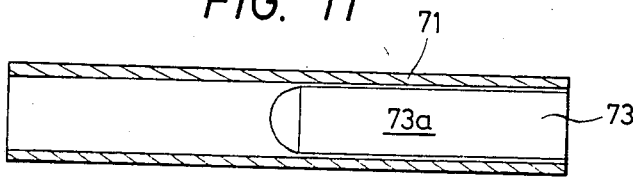
Figure 12:
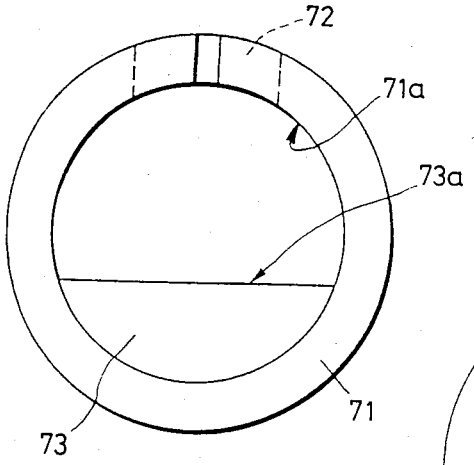
Figure 13:
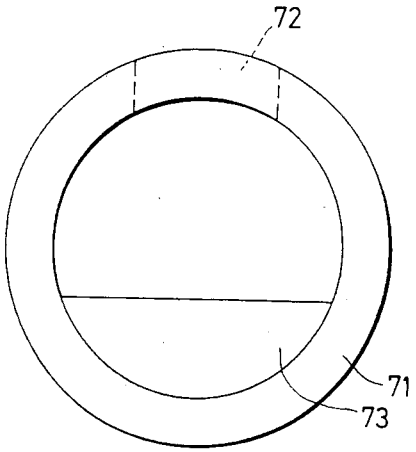
Figure 14:
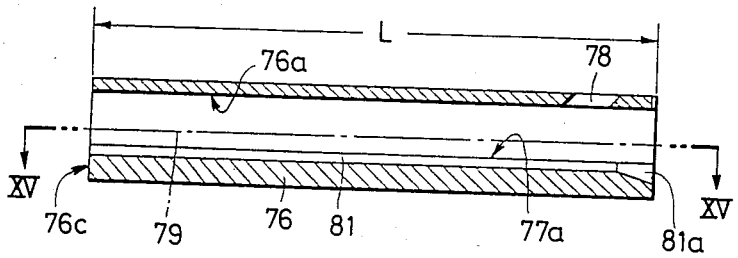
FIGS. 14 to 17 are views illustrating a third embodiment of the untwisting nozzle.

Since the untwisting nozzles 103 and 104 provided adjacent opposite sides of the yarn splicing device have a similar structure, description will be given of only one 104 of the nozzles with reference to FIG. 5. In particular, the block 52 has a nozzle pipe 62 fitted for rotational and axial movement therein. The nozzle pipe 62 has a fluid injecting hole 63 perforated therein in a particular angular relationship to the axis thereof. Due to this angular arrangement of the fluid injecting hole 63, suction air flows are produced at a nozzle opening 64 and cause a yarn end section cut to be sucked into the nozzle pipe 62. The block 52 has a compressed fluid supply path 65 formed therein which is communicated with the injecting hole 63 of the nozzle pipe 62.

Embodiments of the nozzle pipe 62 are illustrated in FIGS. 6 to 13. Referring to FIGS. 6 to 9 which shows a first embodiment, a cylindrical pipe 66 has a compressed fluid injecting hole 67 perforated at a portion thereof which is directed non-tangentially at an angle $\theta$ relative to the axis 68 toward the center of the pipe 66. At a portion within the pipe 62 opposing to the injecting hole 67, an intercepting plate 69 having a flat face **69*a* which is different from and substantially discontinuous to an inner circumferential face 66*a* of the pipe 66 and an arcuate face 69*b* having a radius which is the same as that of the inner circumferential face 66*a* of the pipe 66 is secured by means of a screw or bonding agent with its flat face 69*a* directed toward the injecting hole 67. The term "discontinuous" here means discontinuous in a mathematical sense and does not mean that the flat face 69*a* is discontinuous to the inner circumferential face 66*a* in a physical sense. The intercepting plate 69 extends over the entire length L of the nozzle pipe 66, and preferably the ratio between a distance d1 between a plant containing the pipe axis 68 and the flat plane 69*a* of the intercepting plate 69 and a distance d2 between the pipe inner face 66*a* and the flat face 69*a* is d1:d2=1:2. The pipe 66 is opened at a right end face 66*b* thereof to the block of the yarn splicing device so that a sucking action is caused at an opening of the right end face of the pipe 66 by air flows injected into the pipe 66 through the injecting hole 67. Reference numeral 70 designates a recessed groove formed at a portion of the end face 66*b* of the pipe 66 corresponding to the injection hole 67** and presenting a reference for positioning of the nozzle pipe in a circumferential direction, that is, for adjustment of the nozzle pipe to a position determined in accordance with a relationship of a twisting direction of a yarn relative to the yarn splicing member.

FIGS. 10 to 13 illustrate a second embodiment of the nozzle pipe. A nozzle pipe 71 includes a cylindrical pipe having an air injecting hole 72 perforated at a portion thereof which is inclined relative to the axis of the pipe in a similar manner to the first embodiment. However, an intercepting plate 73 secured to an inner face of the pipe 71 does not extend over the entire length of the pipe but extends only over a distance l1 from a right opening end face **71*b* of the pipe. The distance l1 is at least greater than a distance from the right end face 71*b* to a point 75 at which an extension line 74 of an inclined face 72*a* of the injecting hole 72 crosses a flat face of the intercepting plate 73. This is because it is advantageous for causing turbulent flows that a face which is first met by an air flow injected from the injecting hole 72 is not the curved face of the inner circumference of the pipe but a flat face 73*a*** of the intercepting plate.

FIGS. 14 to 17 illustrate a third embodiment of the nozzle pipe. A pipe 76 includes a cylindrical body having an inner circumferential face **76*a* and an intercepting plate 77 having a flat face 77*a*** and integrally formed with the cylindrical body, and is made of a wear resisting material such as, for example, ceramics.

Figure 15:
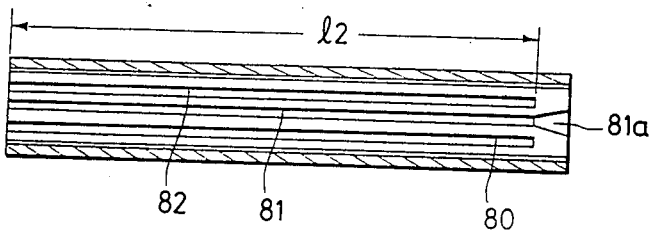
Figure 16:
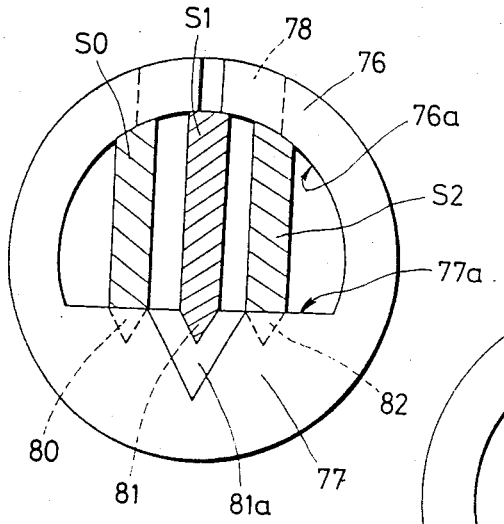
Figure 17:
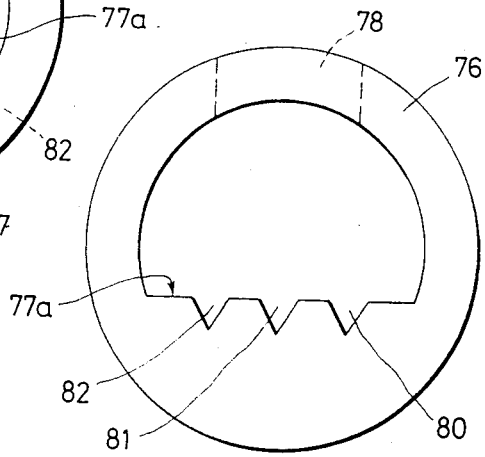
Figure 18:
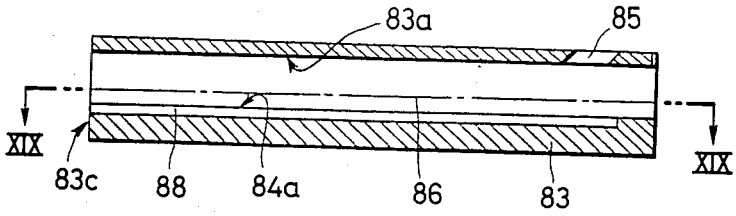
FIGS. 18 to 21 are views illustrating a fourth embodiment of the untwisting nozzle.
Figure 19:
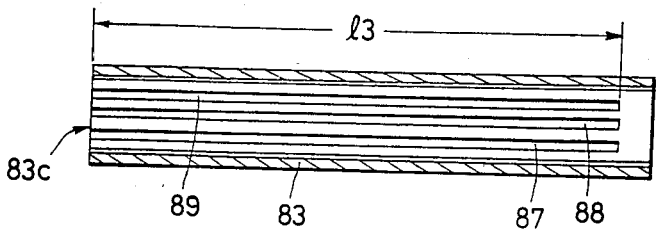
Figure 20:
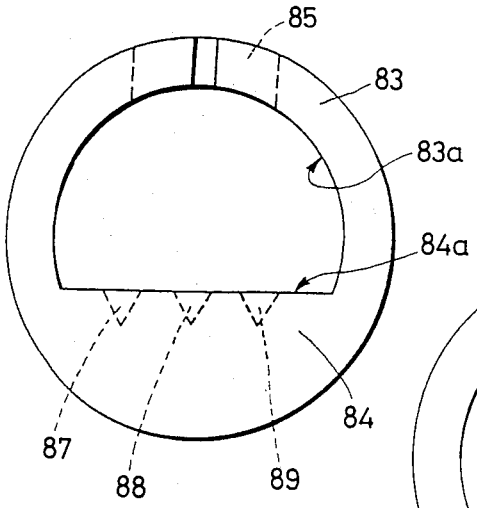
Figure 21:
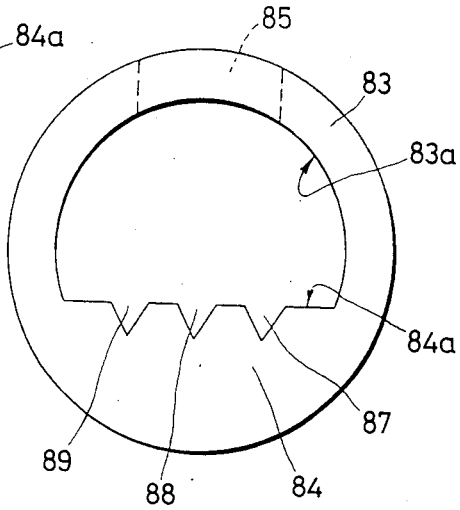
Figure 22:
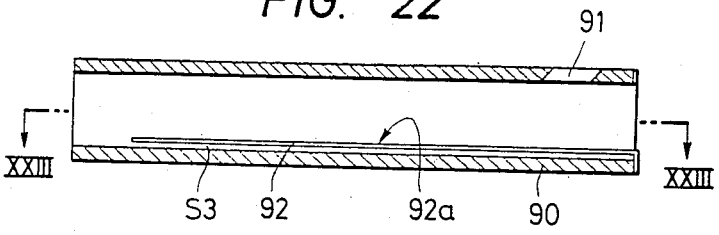
FIGS. 22 to 25 are views illustrating a fifth embodiment of the untwisting nozzle.
Figure 23:
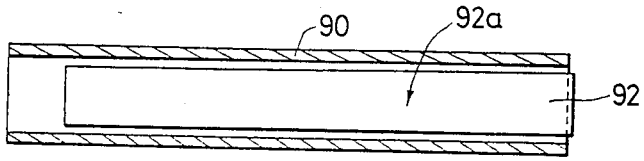
Figure 24:
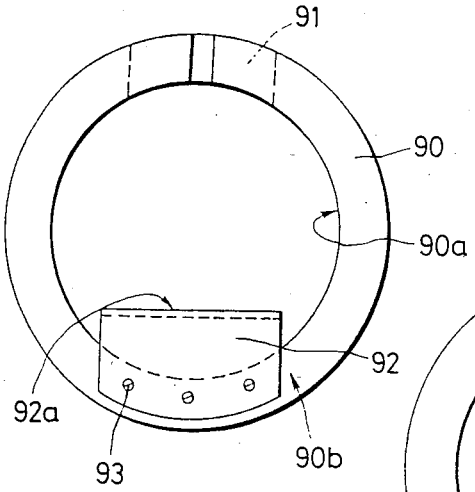
Figure 25:
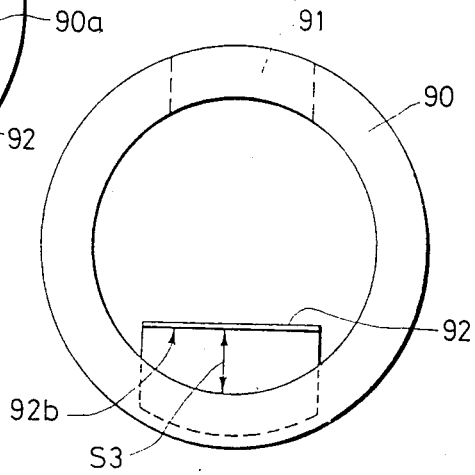

The intercepting plate 77 extends over the entire length L of the pipe, and the pipe 76 has an air injecting hole 78 perforated at a portion thereof opposing to the flat face **77*a* of the intercepting plate in an inclined relationship toward the axis of the pipe 76. The flat face 77*a* of the intercepting plate 77 has a plurality of grooves 80, 81 and 82 formed therein in parallel with the axis 79 of the pipe. In the embodiment, the flat face 77*a* has up to three grooves each presenting a triangular cross section when taken in a perpendicular direction to the axis of the pipe, and the center groove 81 extends over the entire length L of the pipe and has a guide portion 81*a* formed at a yarn end introducing end thereof and having a cross section which becomes larger toward an end face thereof in order to allow a yarn end section to be guided to the center of the groove. The guide grooves 80 and 82 on both sides do not extend over the entire length of the pipe but extend only to a location which is spaced by a distance l2 ($l2<L$) from a left end face 76*c* of the pipe as seen in FIG. 15 and each have a closed extremity at a right-hand side end thereof adjacent the yarn end introducing side of the pipe 76**. It is to be noted that the number, shape of the cross section, length and so on, of the grooves are not limited respectively to those of the embodiment shown and various combinations are possible.

In the nozzle pipe 76, an air flow injected from the injecting hole 78 into the pipe is changed into air flows flowing smoothly in a leftward direction along the grooves 80, 81 and 82, thereby increasing a sucking force and further promoting occurrence of turbulent flows when compared with the intercepting plate which only has a flat face to positively cause oscillations of a yarn end section upon untwisting of the same. Further, since only the central groove 81 extends over the entire length of the pipe, in a section of the pipe taken in a plane perpendicular to the axis of the pipe adjacent the suction opening, a portion S1 of the groove 81 has an area greater than those of portions S0, S2 of the other grooves 80, 82, and accordingly an amount of air flows and hence a sucking force increase toward the center of a shadowed area S1 of FIG. 16. As a result, a yarn end section located at a shadowed area S0 or S2 on either side is inclined to be drawn to the center of the pipe, thereby promoting oscillating motions of a yarn end section between the left and right areas S0 and S2.

FIGS. 18 to 21 illustrate a fourth embodiment of the nozzle pipe. Similarly to the third embodiment, a nozzle pipe 83 includes a cylindrical body having an inner circumferential face 83*a* and an intercepting plate 84 having a flat face 84*a* and formed integrally with the cylindrical body, and is made of a material such as ceramics. The nozzle pipe 83 has an air injecting hole 85 perforated at a portion thereof opposing to the flat face 84*a* of the intercepting plate 84 and directed in an inclined relationship toward the axis 86 of the pipe. The flat face 84*a* of the intercepting plate 84 has grooves 87, 88 and 89 formed therein in parallel with the axis 86 of the pipe 83 and extending from an end face 83*c* from which an air flow goes out to a location spaced a distance 13 from the end face 83*c*. In the present embodiment, the three grooves 87, 88 and 89 have a same configuration and each have a closed end adjacent the yarn end entering end without thus extending over the entire length of the pipe.

Also, the shape of cross sections of the grooves 87, 88 and 89 are not limited to an equilateral triangle and may possibly be any of various shapes such as arcuate or rectangular shapes. Also in the present embodiment, air flows are promoted by the grooves 87, 88 and 89 formed to extend in the axial direction, resulting in increase of a sucking action. Accordingly, turbulent flows are positively produced within the pipe to promote an untwisting action by an oscillation effect of a yarn end section.

FIGS. 22 to 25 illustrate a fifth embodiment of the nozzle pipe. A nozzle pipe 90 includes a cylindrical pipe 90, and an intercepting plate 92 inserted in and secured to a side of the pipe opposing to an air injecting hole 91 formed in the pipe. The intercepting plate 92 is in the form of a tongue of a thin plate, and an end of the intercepting plate 92 adjacent a yarn end entering end of the pipe is bent in an L-shape and is secured to an end face 90*b* of the pipe 90 by means of screws or a bonding agent. The intercepting plate 92 is disposed to provide a gap S3 between a rear face 92*b* of a portion thereof within the pipe 90 and an inner circumferential face 90*a* of the pipe 90 so that high frequency oscillations may be caused to the intercepting plate 92 by air flows injected from the injecting hole 91 to provide an impact force to a yarn end section and turbulent flows may be produced within the pipe 90 by the flat face 92*a* of the intercepting plate 92. It is to be noted that the intercepting plate 92 may be a tongue member made of a metal or a synthetic resin material and may extend over the entire length of the pipe or over a suitable length of the pipe. It is also possible to form a shallow groove in a surface 92*a* of the intercepting plate 92 adjacent the injecting hole 91 in parallel relationship to the axis of the pipe.

Figure 26:
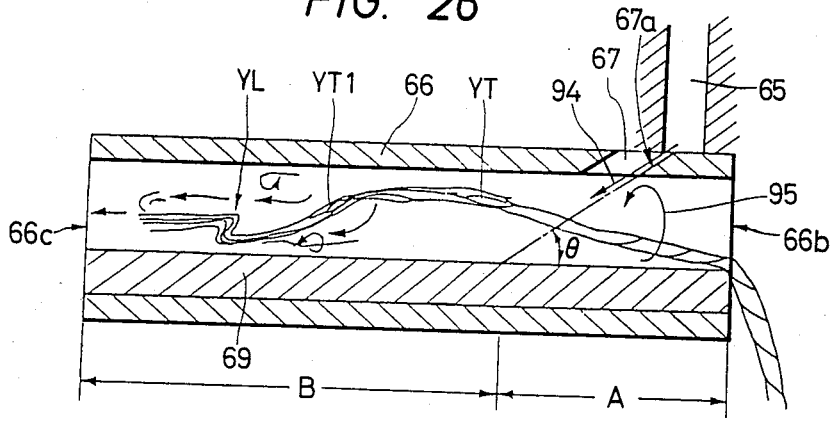
FIG. 26 is a diagrammatic representation illustrating motions of yarn end sections within the untwisting nozzle.
Figure 27:
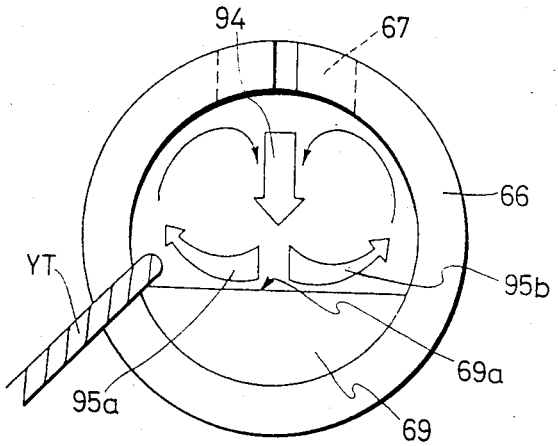
FIG. 27 is a diagrammatic representation illustrating directions of whirling air flows directly after they have been injected into the nozzle pipe.

An untwisting operation of a yarn end section in the nozzle pipes as described above is illustrated in a schematic representation in FIGS. 26 and 27.

It is to be noted that while description will be given of a case where the nozzle pipe 66 of the first embodiment is used, a basic principle in untwisting operations can be applied to any of the remaining nozzle pipes illustrated in the drawings and described hereinabove.

Referring first to FIG. 26, compressed air supplied from the compressed air supplying path 65 into the injecting hole 67 of the untwisting nozzle pipe 66 is injected in a direction as indicated by an arrow mark 94 along the inclined face 67*a* of the injecting hole 67 and flows as a whole toward the opening 66*c* at the left end of the pipe 66, causing a suction air flow at the opening 66*b* at the right end of the pipe 66 to suck an end section YT of a yarn cut to a predetermined dimension.

Meanwhile, an air flow injected into the nozzle pipe 66 causes a whirling air flow 95 in a region A while causing a turbulent flow in the remaining region B. In particular, in the neighborhood of the injecting hole 67 directly after the air flow is injected therefrom, air injected in the direction of the arrow mark 94 from the injecting hole collides with the flat face 69*a* of the intercepting plate 69 and is diverged thereby into flows 95*a* and 95*b* which whirl symmetrically in opposite directions. In the region B, the whirling flows are hindered from whirling by the flat face 69*a* of the intercepting plate 69 and hence the region B now becomes a turbulent flow region.

Accordingly, in the region A of the nozzle pipe 66, the yarn end section is turned, that is, the yarn end section is exposed to whirling flows in a direction opposite to that of the second twist of the so-called ply yarn so that the second twist of the yarn is untwisted. The yarn YT of FIG. 27 is a ply yarn having a second twist in the S direction, and a section of the yarn in the region A is here turned in the clockwise direction by the whirling flow 95*a* whirling in the clockwise direction so that the second twist of the yarn YT is untwisted positively by the whirling flow 95*a*. In addition, a section VT1 of the yarn and end section in the region B is caused to effect irregular movement by turbulent flows so that, as shown in FIG. 26, a bent portion YL is produced adjacent the extremity of the yarn end section and hence the yarn end section is hit against the intercepting plate 69 or is caused to effect oscillating motions, resulting in untwisting of the first twist of the yarn end section the second twist of which has been already untwisted. Thus, untwisting of a ply yarn can be successfully attained which cannot be untwisted with a cylindrical untwisting nozzle pipe having a mere circular inner face which is disclosed in the patent application filed in prior to the present patent application by the present applicant.

Figure 28:
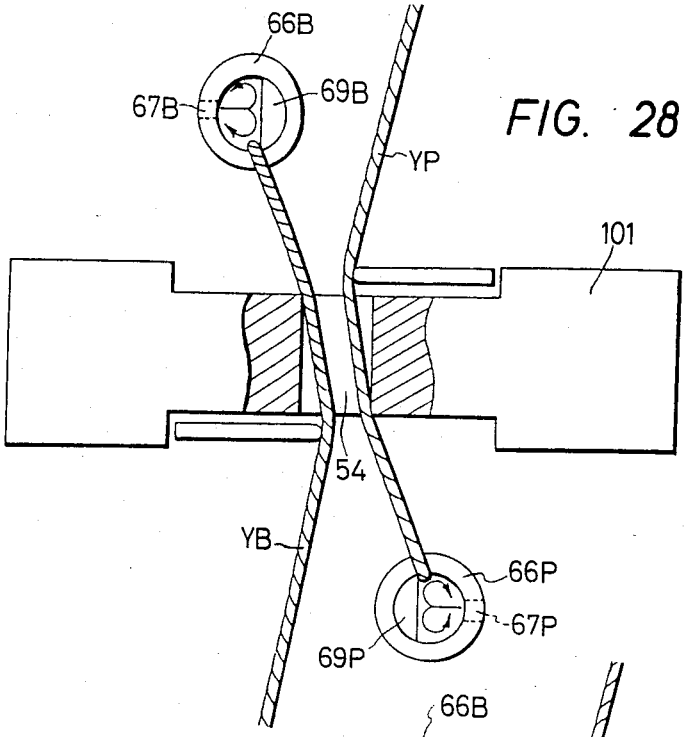
FIGS. 28 to 30 are diagrammatic representations illustrating relations between positions of the untwisting nozzles and directions of second twists of ply yarns, and FIG. 28 showing such a relation where a ply yarn is used wherein the second twist is the S twist, FIG. 29 showing such a relation where a ply yarn wherein the second twist is the Z twist is used and the untwisting nozzle of the first embodiment is applied, and FIG. 30 showing such a relation where a ply yarn wherein the second twist is the S twist and the untwisting nozzle of the third embodiment is applied.
Figure 29:
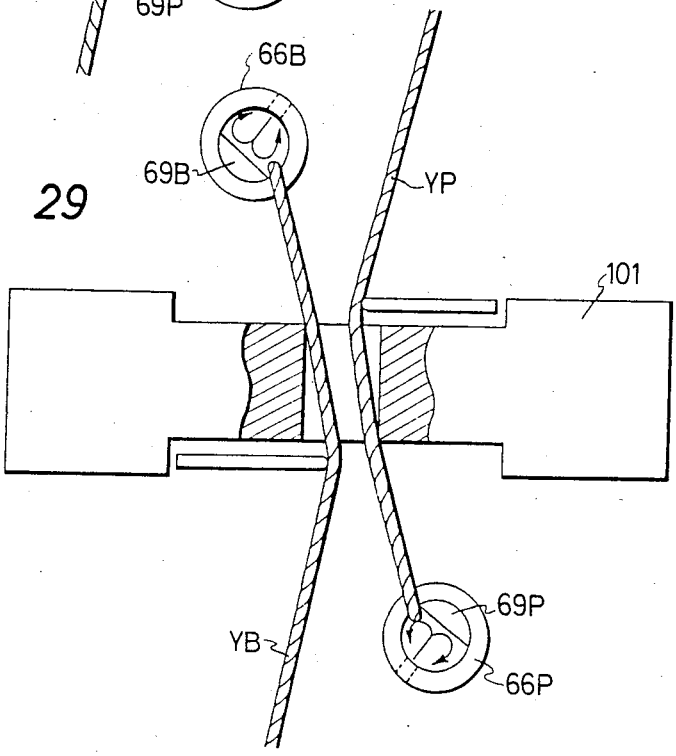
Figure 30:
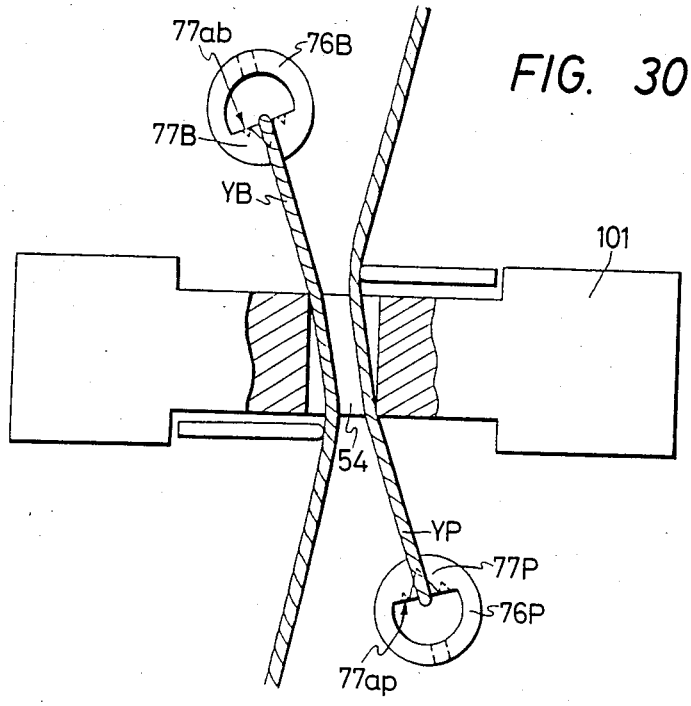

FIGS. 28 to 30 illustrate the nozzle pipes which are applied to the untwisting nozzles 103 and 104 shown in FIG. 2 and show positions of the nozzle pipes relative to the twisting directions of the second twist of yarns to be spliced to each other.

FIG. 28 illustrate the nozzle pipes where the second twist of end sections of yarns used in the S twist. Nozzle pipe provided adjacent opposite sides of the yarn splicing member 101 are individually secured in psoition such that an intercepting plate 69B of the upper nozzle pipe 69B is located on the right hand side while the intercepting plate 69P of the lower nozzle pipe 66P is located on the left hand side so that a yarn end section sucked into the nozzle pipe through the yarn splicing hole 54 of the yarn splicing member 101 may be positioned in a whirling flow region in which the second twist of the yarn end section is untwisted. In particular, the yarn end sections YP and YB wherein the second twist is the S twist are sucked to a position at which appears one of symmetrical air flows injected from the injecting holes 67P and 67B of the nozzle pipes 66P and 66B, respectively, which whirls in the clockwise direction.

FIG. 29 illustrates an arrangement of the nozzle pipes 66P and 66B where the twist of yarns used is the Z twist. In this arrangement, the nozzle pipes 66B and 66P are positioned so that a yarn end section may be positioned in a region in which a whirling flow produced from an air flow injected from the injecting hole 67B or 67P appears in the counterclockwise direction.

FIG. 30 illustrates another arrangement to which the nozzle pipes 76 of the third embodiment as shown in FIGS. 14 to 17 are applied. In the arrangement, nozzle pipes 76B and 76P are secured in position such that flat faces 77*a*B and 77*a*P of the intercepting plates thereof are opposed to the yarn splicing hole 54 in order that yarn end sections YB and YP may be guided into the central grooves formed in the intercepting plates 77B and 77P, respectively. In this arrangement, both yarns of the S and Z second twists can be used. It is to be noted, however, that the nozzle pipes 76B and 76P can be disposed in accordance with the direction of the second twist of a yarn used so that yarn end sections may be sucked into a region in which a whirling flow whirls in a direction to untwist the second twist, as in the arrangement of FIG. 28 or 29 and as described hereinabove. In any case, untwisting of yarns can be attained.

Yarn splicing operations with the above-sescribed yarn splicing device will be described now.

(a) Yarn Preparing, Clamping Step

Referring to FIG. 1, when the detecting device 8 detects that a yarn during rewinding is broken or a yarn layer on a bobbin has been used up, rotation of the drum 9 is stopped while a one revolution clutch not shown is rendered operative so that a yarn splicing operation may be effected either by means of several control cams mounted on a shaft which is connected to be rotated via the clutch or by means of several control cams operatively connected to the shaft.

At first, the suction mouth 10 and the relay pipe 11 are pivotally moved from the respective phantom positions 10*a* and 11*a* of FIG. 1 with yarn end sections sucked therein, respectively. During this movement, they pass over the yarn splicing device 12 in such a manner that a yarn YP on the package P side and another yarn YB on the bobbin B side cross each other, and they stop at respective positions outside the yarn splicing device.

In particular, at a time during a period after initiation of operation of the suction mouth 10 until the relay pipe 11 initiates its operation, the yarn clamping device 109 on the package side of FIG. 2 is rendered operative so that the yarn YP is clamped between the pivotal lever 20 and the support block 21 and then introduced into the guide groove 19 defined by the fixed guide 16 and the pivotal guides 17 and 18 all disposed in the neighborhood of the detecting device 8 in order to effect checking with the detecting device 8. Subsequently, the pivotal guides 17 and 18 are pivoted in the counterclockwise direction in FIG. 3 around the pivot shaft 22 to thus remove the yarn YP from the detecting device 8 and to fit the same into the relief grooves 17*b* and 18*b*.

Then, the relay pipe 11 sucks the yarn YB on the bobbin B side therein and is pivoted to and stops at a position outside the yarn splicing device 12.

At this instant, the yarn YB is clamped between the support plate 23*a* of the yarn clamping device 108 and the support block 23*b*.

(b) Yarn Putting Aside, Cutting Step

After completion of the yarn clamping steps, the arms 32 and 33 of the yarn handling lever 105 shown in FIGS. 2 and 3 are pivotally moved around the support shaft 31 to introduce the yarns YP and YB on both sides individually into the guide grooves 29*a*, 29*b* and 30*a*, 30*b* of the fork guides 29 and 30, respectively while they are inserted into the yarn splicing hole 54 of the yarn splicing member 101 of FIG. 4 through the slit 55.

Figure 31:
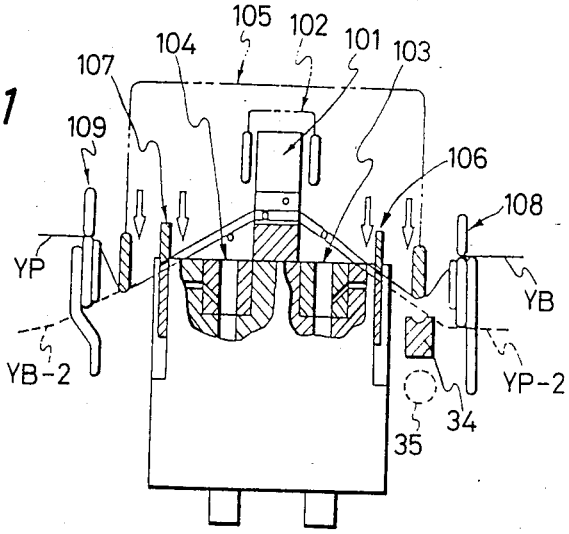
FIGS. 31 to 33 are diagrammatic representations illustrating different steps of a yarn splicing operation.
Figure 32:
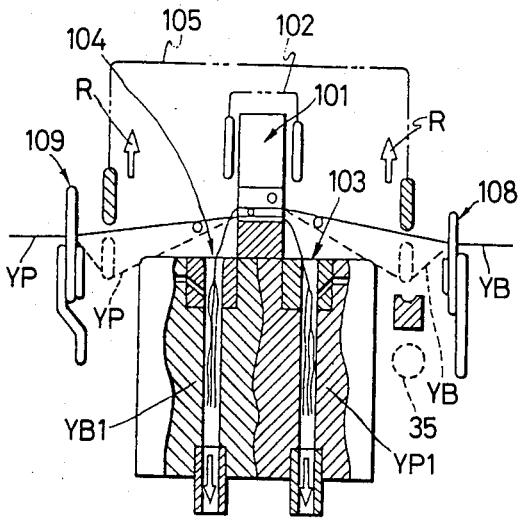

Then, the yarn cutting devices 106 and 107 are rendered operative to effect cutting of yarns YP2 and YB2 as seen in FIG. 31 at positions spaced by a predetermined distance from th clamping devices 108 and 109, respectively.

The positions at which yarns are cut relate to the length of a joint of the yarns to be spliced and have influence on an appearance of the joint of the yarns spliced and also on the strength of the joint. Thus, such positions are differentiated by the count of a yarn used.

In particular, referring to FIG. 31, while the yarns YP and YB on both sides of the yarn splicing member 101 are clamped by the clamping devices 108 and 109, respectively, the yarn handling lever 105 is rendered operative and the rod 31*a* shown in FIG. 3 is moved in a direction of an arrow mark 31*b* by means of a control cam not shown to pivot the lever 32 in the clockwise direction around the support shaft 31. In this condition, a cutting operation is carried out.

It is to be noted that when the handling lever 105 and the cutting devices 106 and 107 are operated, the yarn pressing device 102 is ready for operation at a position as shown in FIG. 31.

(c) Yarn End Untsisting Step

Subsequently, the yarn end sections YP1 and YB1 are sucked by and into the yarn end untwisting nozzles 103 and 104, respectively, and at the same time with or just before or after this sucking action, the yarn handling lever 105 is moved in a direction R away from the yarns so that the yarn end sections YP1 and YB1 are allowed to be sucked deeply into untwisting nozzles in which the twist thereof is untwisted into a condition adapted for splicing of yarns by means of injecting of fluid, as described hereinabove.

Preferably, the sucking operation of the untwisting nozzles 103 and 104 is initiated just before yarns are cut by the cutting devices 106 and 107, respectively.

This is because, since a tensile force is applied to a yarn Y due to a sucking action of the suction mouth and the relay pipe when the yarn Y is cut, the yarn end sections YP1 and YB1 which are let free by cutting thereof will sometimes be scattered and thus moved away from the openings of the untwisting nozzles 103 and 104, resulting in an error in suction of yarn end sections by the untwisting nozzles.

It is to be noted that supply of fluid to the untwisting nozzles may be effected by changing over of a valve by means of a solenoid not shown.

(d) Yarn Splicing Step

After the twist of the yarn end sections YP1 and YB1 have been untwisted into a condition suitable for splicing of yarns by means of the yarn end untwisting nozzles 103 and 104, respectively, the sucking actions of the untwisting nozzles 103 and 104 and the fluid injecting hole 63 are all stopped. At the same time with or just before or after such stopping, the yarn handling lever 105 is rendered operative again to guide the yarn end sections YP1 and YP1 to draw them out of the untwisting nozzles 103 and 104 and place the thus untwisted yarn end sections one on the other at a predetermined position on the yarn splicing member.

Figure 33:
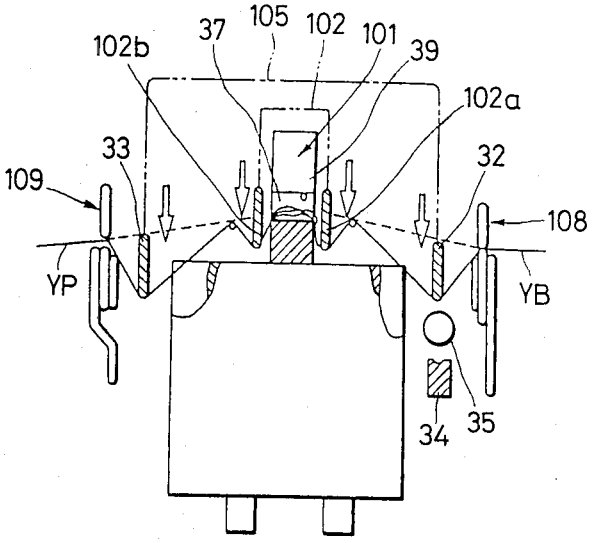

In this case, one 32 of the arms of the yarn handling lever 105 is pivoted to a position in which it is abutted against the stop 35, and the yarn pressing device 102 is operated to pivot to a position as shown in FIG. 33 in which yarn holding plates 102*a* and 102*b* thereof cooperate with the guide rods 28*a* and 28*b*, respectively, to provide curved configurations to portions of the yarns YP and YB between the yarn splicing hole 54 and the clamping devices 108 and 109 or more specifically between the yarn splicing hole 54 and the yarn handling arms 32 and 33.

The yarn end sections YP1 and YB1 inserted in the nozzle holes of the untwisting nozzles 103 and 104 by means of the yarn handling lever 105 and the yarn pressing device 102 are then drawn toward within the yarn splicing hole 54 of the yarn splicing member 101 and are thus positioned in mutually contacted conditions by cooperation of the control plates 25 and 26 and the yarn pressing device 102 as shown in FIGS. 3 and 4.

After completion of positioning of the yarn end sections, splicing of the yarns is effected by a whirling flow of compressed fluid which is injected from the fluid injecting holes 56 and 57 of FIG. 4.

In particular, the first and second twists of the yarn end sections are untwisted by the untwisting nozzles 103 and 104 so that fibers of the yarn end sections are released from each other into a substantially parallel condition. As a result, the fibers at the end sections of the yarns are mixed, interlaced and united with one another into one spliced yarn. Accordingly, the strength of a joint obtained in this manner is held to 70 to 80 percent of that of an parent yarn.

As apparent from the foregoing description, according to the present invention, a yarn end untwisting nozzle of a pneumatic spinning yarn splicing device includes a fluid injecting hole formed to open to an inner circumferential face of a pipe of the nozzle, and an intercepting plate disposed on the inner circumferential face of the pipe in opposing relationship to the fluid injecting hole and having a face different from the inner circumferential face of the pipe. Accordingly, directly after fluid has been injected into the nozzle pipe, it collides with the intercepting plate thereby to promote production of turbulent flows of the fluid, and the yarn end sections sucked into the nozzle pipe are caused to positively effect whirling or non-whirling motions, that is, oscillating motions as described hereinabove due to actions of whirling flows directly after the fluid has been injected and also of turbulent flows within the nozzle pipe. As a result, even a spinning yarn called a ply yarn wheren the direction of the first twist is opposite to the direction of the second twist can be untwisted at an end section thereof, thereby enabling pneumatic yarn splicing of such ply yarns to each other.

What is claimed is:

1. A yarn splicing device for splicing spun yarns to each other wherein end sections of two yarns are placed in overlapping relationship one on the other and thus overlapping portions of the yarns are acted upon by fluid to effect intended splicing of the yarns, characterized in that an untwisting nozzle for sucking yarn end sections and for untwisting the yarn end sections by an action of a flow of the fluid comprises a nozzle pipe, a fluid injecting hole formed to open to an inner circumferential face of the nozzle pipe, and an intercepting plate disposed within the nozzle pipe, said intercepting plate being so constructed that a turbulent flow is produced in the nozzle pipe when the fluid is jetted from the fluid injecting hole.

2. A yarn splicing device as claimed in claim 1, wherein said intercepting plate is disposed in opposing relationship to said fluid injecting hole.

3. A yarn splicing device as claimed in claim 1, wherein said intercepting plate extends over the length of the nozzle pipe.

4. A yarn splicing device as claimed in claim 1, wherein said intercepting plate extends from an opening end face of the nozzle pipe at least over a point at which an extension line of an inclined face of the injecting hole crosses a face of the intercepting plate.

5. A yarn splicing device as claimed in claim 1, wherein said intercepting plate having a flat face is integrally formed with a cylindrical body of the nozzle pipe.

6. A yarn splicing device as claimed in claim 5, wherein said flat face has a plurality of grooves formed therein in parallel with the axis of the nozzle pipe.

7. A yarn splicing device as claimed in claim 6, wherein said groove has a triangular cross section in a perpendicular direction to the axis of the nozzle pipe and the center groove extends over the entire length of the nozzle pipe and has a guide portion formed at a yarn end introducing end thereof and having a cross section which becomes larger toward and end face thereof in order to allow a yarn end section to be guided to the center of the groove.

8. A yarn splicing device as claimed in claim 6, wherein said grooves have a same configuration and each have a closed end adjacent the yarn end entering end of the nozzle pipe.

9. A yarn splicing device as claimed in any of claims 5 to 8, wherein said cylindrical body of the nozzle pipe and intercepting plate formed integrally therewith are made of ceramics.

10. A yarn splicing device as claimed in claim 1, wherein said intercepting plate is in the form of a tongue of a thin plate and an end of the intercepting plate adjacent a yarn end entering end of the nozzle pipe is bent in an L-shaped and is secured to an end face of the nozzle pipe to provide a gap between a rear face of the intercepting plate within the nozzle pipe and the inner circumferential face of the nozzle pipe.

11. A yarn splicing device as claimed in claim 1, wherein a recessed groove is formed at a portion of the end face of the nozzle pipe corresponding to the injecting hole to present a reference for positioning of the nozzle pipe in a circumferential direction.

* * * * *